United States Patent [19]

Willems

[11] Patent Number: 4,791,671

[45] Date of Patent: Dec. 13, 1988

[54] SYSTEM FOR ANALYZING HUMAN SPEECH

[75] Inventor: Leonardus F. Willems, Eindhoven, Netherlands

[73] Assignee: U.S. Philips Corporation, New York, N.Y.

[21] Appl. No.: 691,594

[22] Filed: Jan. 15, 1985

[30] Foreign Application Priority Data

Feb. 22, 1984 [NL] Netherlands ..... 8400552

[51] Int. Cl.[4] ..... G10L 5/00

[52] U.S. Cl. ..... 381/49

[58] Field of Search ..... 381/29-31, 381/38, 41, 47, 49; 364/513.5

[56] References Cited

U.S. PATENT DOCUMENTS

| | | | |
|---|---|---|---|
| 2,908,761 | 10/1959 | Raisbeck | 381/38 |
| 3,535,454 | 3/1968 | Miller | 381/38 |
| 4,384,335 | 5/1983 | Duifhuis et al. | 381/49 |
| 4,653,098 | 3/1987 | Nakata et al. | 381/49 |

*Primary Examiner*—Emanuel S. Kemeny

*Attorney, Agent, or Firm*—David R. Treacy

[57] ABSTRACT

The pitch of human speech segments is analyzed using at least two different pitch detection algorithms, a respective plurality of most likely values of pitch is selected by each of those algorithms, and these values and their respective quality figures are analyzed statistically to determine the most likely pitch. One algorithm operates in the frequency domain, by analyzing an amplitude spectrum, and the other algorithm operates in the time domain using an autocorrelation function. Significant peak positions of the amplitude spectrum or autocorrelation function are evaluated in respective harmonic sieves, to provide respective quality figures indicating the degree to which peak frequency or period periods of the spectrum or autocorrelation function output match the apertures of the harmonic sieve. A predetermined number of values of pitch, and of period, are selected having the highest quality figures. After conversion of the values for period into values of pitch, these values with their associated quality figures are analyzed statistically to form an estimation of the most likely pitch.

8 Claims, 8 Drawing Sheets

SYSTEM FOR ANALYZING HUMAN SPEECH

BACKGROUND OF THE INVENTION

1. Field of the Invention

Systems for analyzing human speech, for determining the pitch of speech segments operate in many different ways. To obtain more accurate results, some use more than one pitch detection algorithm.

2. Description of the Prior Art

A system as defined above is known from Prior Art References. In the system described therein, use is made of the autocorrelation method, the spectrum method and of the low-pass filter wave form method. As described in this publication the choice of these methods is determined by the wish to obtain reasonably independent estimates of the pitch.

The autocorrelation method directly uses Prior Art information from the time domain, whereas the spectrum method utilizes information from the frequency domain. Other methods using information from the frequency domain are known, for example the Prior Art harmonic sieving method. Therein, the amplitude spectrum is determined for a short segment (40 ms) of the sampled signal and thereafter a search is made in the amplitude spectrum for the frequency positions of the significant peaks of the amplitude (significant peak positions) and finally—by what is denoted as the harmonic sieve—a pitch is sought for, whose harmonics are the closest match to the significant peak positions of the amplitude spectrum.

In the methods mentioned here for determining the pitch in speech, problems arise which are characteristic of each method. In general it can be said that methods operating in the frequency domain frequently make errors when used for high pitches and that methods operating in the same domain make errors for lower pitches and often indicate multiples of the actual pitch as the pitch.

SUMMARY OF THE INVENTION

The object of the invention is to provide a speech-pitch detecting system with two detection algorithms which provide in an optimum way complementary pitch data. Over the range from low to high pitches these algorithms are complementary as regards the reliability of the information, one detection algorithm being reliable for the low pitch range and the other algorithm being reliable for the high pitch range.

According to the invention, a first elementary pitch meter determines the amplitude spectrum of the speech segment and significant peak positions therein; a second elementary pitch meter determines the autocorrelation function and significant peak positions therein; and harmonic sieves are used in a process of computing quality figures for these significant peak positions of the amplitude spectrum and the significnt peak positions of the autocorrelation function. Each of these computations involves the following steps:

(1) the selection of a value for the pitch and period, respectively and the determination of a sequence of consecutive integral multiples of this value, and the determination of intervals around this value and the multiples thereof, these intervals defining apertures of a mask, harmonic numbers corresponding to the multiplication factors in said multiples pertaining to these apertures;

(2) the computation of a quality figure in accordance with a criterion indicating the degree to which the significant peak positions and the mask apertures match;

(3) the repetition of the preceding steps for consecutive higher values of the pitch and period, respectively up to a predetermined highest value, resulting in a sequence of quality figures associated with these pitch and period values;

(4) the selection of three values of the pitch and period, respectively having the highest quality figures; and (5) the conversion of the values for the period into values for the pitch.

The values thus found for the pitch from each of the pitch meters, with the associated quality figures, are then combined and weighted statistically to select an estimate of the most likely pitch.

During combining of the data still further data may alternatively be taken into account, for example measuring data from the recent past to thus guarantee also time continuity of the pitch determination.

PRIOR ART REFERENCES

1. L. R. Rabiner et al., "A semi-automatic pitch detector (SAPD)", IEEE Transactions on acoustics, speech and signal processing, Vol. ASSP-23, No. 6, December 1975, pp. 570–574.

2. L. R. Rabiner, "On the use of autocorrelation analysis for pitch detection", IEEE Transactions on acoustics, speech and signal processing, Vol. ASSP-25, No. 1, February 1977, pp. 24–33.

3. Netherlands Patent Application 78 12 151 to which U.S. Pat. No. 4,384,335 corresponds.

DESCRIPTION OF THE PREFERRED EMBODIMENT

Figure 1:
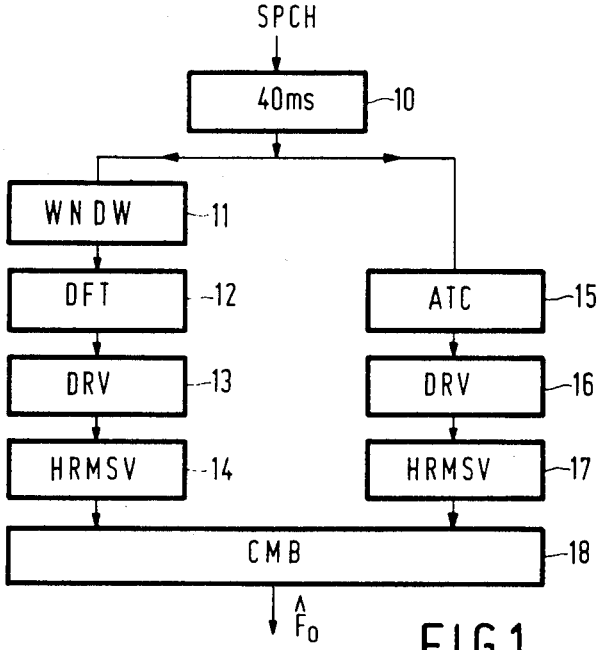
FIG. 1: a block diagram of the embodiment.

The speech analysis system shown in FIG. 1 determines the pitch of speech signals in a range from 50 Hz to 500 Hz. In a speech analysis system of the present type this object is accomplished by:

taking as a starting point a speech segment having a duration of 40 ms, as represented by block 10;

the determination of the amplitude spectrum of this segment by applying a window in block 11 and a Fourier transform in block 12;

the determination of significant peak positions in this amplitude spectrum as shown in block 13;

checking whether the peak positions found match a harmonic sequence in block 14 having the inscription: "HRMSV". The function of block 14 is described as a harmonic sieve function and comprises the following steps:

the selection of a value for the pitch and the determination of a sequence of consecutive integral multiples of this value and the determination of intervals around this value and the multiples thereof, these intervals defining apertures of a mask, harminic numbers corresponding to the multiplication factors in the said multiples pertaining to these apertures;

the computation of a quality figure in accordance with a criterion indicating the degree to which the significant peak positions and the mask apertures match;

the repetition of the preceding steps for consecutive higher values of the pitch up to a predetermined higher value; resulting in a sequence of quality figures associated with these pitch values;

the selection of three values of the pitch having the highest quality figures.

the determination of significant peak positions in the autocorrelation function (block 15) of that some speech segment in block 16;

checking whether the peak positions found match a harmonic sequence as indicated in block 17, which as regards its operation is similar to block 14. This is effected by the selection of a value for the period and the determination of a sequence of consecutive integral multiples of this value and the determination of intervals around this value and the multiples thereof, these intervals defining apertures of a mask, harmonic numbers corresponding to the multiplication factors in the said multiples pertaining to these apertures;

the computation of a quality figure in accordance with a criterion indicating the degree to which the significant peak positions and the mask apertures match;

the repetition of the preceding steps for consecutive higher values of the period up to a predetermined highest value, resulting in a sequence of quality figures associated with these pitch values;

the selection of three values of the period having the highest quality figures;

converting the values for the periods into values for the pitch;

combining the values thus found for a pitch with the associated quality figures to form an estimate of the most likely pitch indicated by block 18.

In the speech analysis system described here the so-called harmonic sieve, indicated by blocks 14 and 17 in FIG. 1 constitutes an important component.

Figure 2:
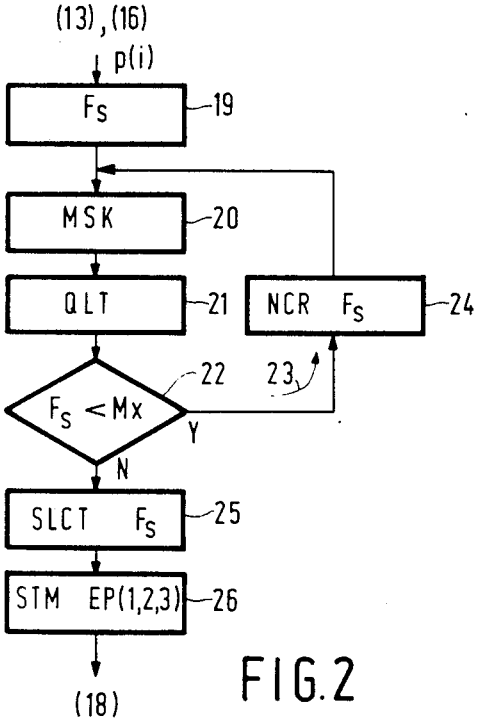
FIG. 2: block diagram of a procedure which is repeatedly used and which has for its object to detect a harmonic relationship between a series of numbers at the input.

The operation of the harmonic sieve is further illustrated in FIG. 2, the sieve operating on significant peak positions p(i) which are either frequencies (block 14) or periods (block 17). The description will be given with reference to block 14 in terms of frequencies (pitches), when they are changed to periods then the description relates to block 17. In this process a value $F_s$ for the pitch is first assumed, as represented in block 19.

Intervals are defined around this initial value and a number of consecutive integral multiples thereof. These intervals are considered as apertures in a mask in that sense that a numerical value which coincides with an aperture will be transmitted by the mask. In this assumption the mask functions as a kind of sieve for numerical values. These operations are represented by block 20 bearing the inscription MSK.

Numbers which are denoted as harmonic numbers and correspond to the multiplication factors of the relevant multiples of the selected values of the pitch are associated with the apertures of a mask.

The degree to which the significant peak positions p(i) and the apertures of the mask match is determined in a subsequent operation. If only a few significant peak positions are transmitted by the mask then there is clearly a poor match. If on the other hand many of the peak positions are transmitted but many apertures in the mask do not transmit significant peak positions because they are not present in that location, then there is also a poor match.

It is possible to find a proper criterion to express the degree of matching in quality figure, as will be explained hereinafter. Let it suffice at this point of the description to say that a quality figure is computed for the mask. This operation is represented by block 21, bearing the inscription QLT.

In the decision diamond 22 a check is made whether the value $F_s$ selected for the pitch is below a given maximum value: $F_s < Mx$. If this is the case, then the Y-branch of diamond 22 is followed, resulting in a loop 23 to block 24. In this loop the value of $F_s$ is increased in a certain manner: either by a given amount or by a given percentage. This function is represented by block 24 bearing the inscription NCR $F_s$.

The result of the presence of decision diamond 22 is that the operations which are represented by the blocks 20 and 21 are continuously repeated for always new values of $F_s$, until $F_s$ reaches the maximum value Mx. When this is the case the N branch is followed and loop 23 is left.

The subsequent operation in the present system of speech analysis consists in selecting three values of $F_s$ whose quality figures have the highest values. This is effected in block 25 bearing the inscription SLCT $F_s$.

In the present speech analysis system an accurate estimation is thereafter made of the possible pitches, starting from the three selected values of $F_s$. This last step in the procedure for determining the pitch is represented by block 26 bearing the inscription STM EP(1, 2, 3), whose output branch supplies the three estimated values EP(1, 2, 3) of the pitch. In this block 26 the harmonic numbers of the apertures of the reference mask are associated with the significant peak positions p(i) coinciding with these apertures and each of these peak positions p(i) will then obtain a harmonic number $n_i$ which determines the position of the peak positions in a sequence of harmonics of the same fundamental tone. A good estimate of $F_o$: $\hat{F}_O$ can be defined as being the value for which the deviations between the last-said significant peak positions p(i) and the corresponding multiples $n_i.\hat{F}_o$ of the probable value are as small as possible. When a m.s.e. criterion (mean-square error) is used for the determination of the deviations then $\hat{F}_o$ can be calculated by means of the expression:

$$\hat{F}_o = \sum_{i=1}^{K} p(i) \cdot n_i / \sum_{i=1}^{K} n_i^2 \quad (1)$$

The summation in this expression extends across all significant peak positions coinciding with an aperture of the reference mask the number of which is represented by K. Apart from that, the value of the pitch associated with the reference mask forms already a first estimate of the pitch sought for.

FREQUENCY DOMAIN SECTION

Figure 3:
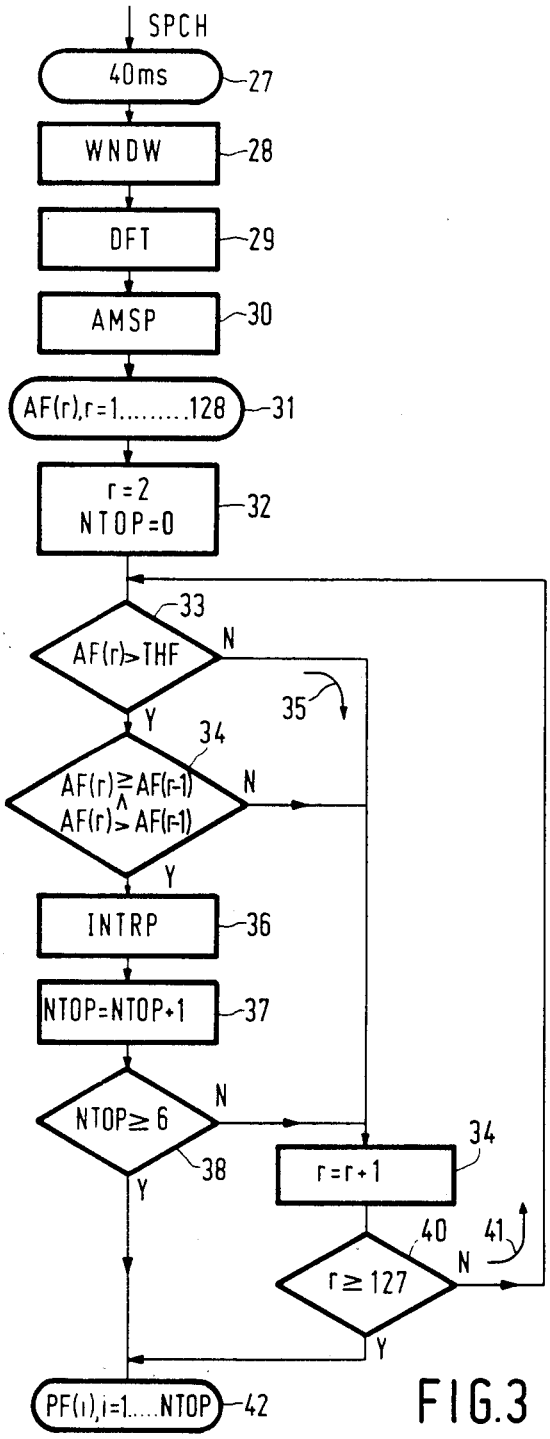
FIG. 3: circuit diagram for determining significant peak positions in the amplitude spectrum.

FIG. 3 illustrates in greater detail the procedure for obtaining the values of the significant peak positions in the frequency domain.

Time segments having a duration of 40 ms are taken from the sampled speech signal. This function is represented by block 27, bearing the inscription 40 ms. The subsequent operation is multiplying the speech signal segment by a so-called "Hamming window", which function is represented by block 28 bearing the inscription WNDW. Thereafter the speech signal segment samples are subjected to a discrete 256-point Fourier transform, as represented by block 29, bearing the inscription DFT.

In the subsequent operation of block 30 (AMSP) the amplitudes of 128 spectrum components are determined from the 256 real and imaginary values produced by the DFT. The significant peak positions PF(i) which represent the positions of the peaks in the spectrum are derived from these spectrum components.

Some operations of the present speech analysis system can be implemented in the software of a general-purpose computer. Other operations can be accelerated by using external hardware.

From block 30 onwards the procedure is implemented by the software of a general-purpose computer.

The computer receives an input data the components AF(r), r=1, . . . , 128 of the amplitude spectrum as represented by block 31. As initial values for the routine the following values are taken: r=2 and NTOP=0. This function is represented by block 32. NTOP is a variable which counts the number of local maxima found.

Starting with spectrum component AF(2) it is investigated in decision diamond 33 whether the spectrum components AF(2) exceeds a threshold value THF. The N-branch of diamond 33 leads to block 39 which indicates that r must be incremented by one. Thereafter it is investigated in decision diamond 40 whether r has become larger than or equal to 127. As long as this is not the case a loop 41 to block 33 is formed. The function of block 33 is then repeated with a new value of r.

The Y-branch of decision diamond 33 leads to decision diamond 34 in which it is investigated whether the spectrum component AF(2) exceeds or is equal to the preceding spectrum component AF(1) and whether spectrum component AF(2) exceeds the subsequent spectrum component AF(3). This function is represented by decision diamond 34. When the spectrum component forms a local maximum the Y-branch of diamond 36 is followed.

The N-branch of diamond 34 leads to block 39 which indicates that r is increased by one as long as the new value of r is below 127. The threshold value THF is formed in the first instance by an absolute value which is determined by the level of the noise resulting from the quantization and the "Hamming window".

In the second place, a portion of the threshold value THF may be variable so as to take into account the masking of a spectrum component by the adjacent spectrum components when these spectrum components have a much larger amplitude. This effect occurs in the human sense of hearing and is there an important factor in the detection of the pitch.

When the Y-branch of decision diamond 34 is followed then an operation is effected to determine the amplitude and the frequency of the local maximum of the amplitude spectrum. For this purpose use is made of interpolation between the values AF(r−1), and AF(r+1) with a second-order polynomial (parabolic interpolation). This function is represented by the block 36 bearing the inscription INTRP. In block 37 the number of local maxima is now increased by one.

The search for local maxima of the amplitude spectrum is continued until a maximum of six significant peak positions PF(i) have been determined. When this is the case then the Y-branch of decision diamond 38 becomes active and the significant peak positions PF(i) are led out (block 42).

Figure 4A:
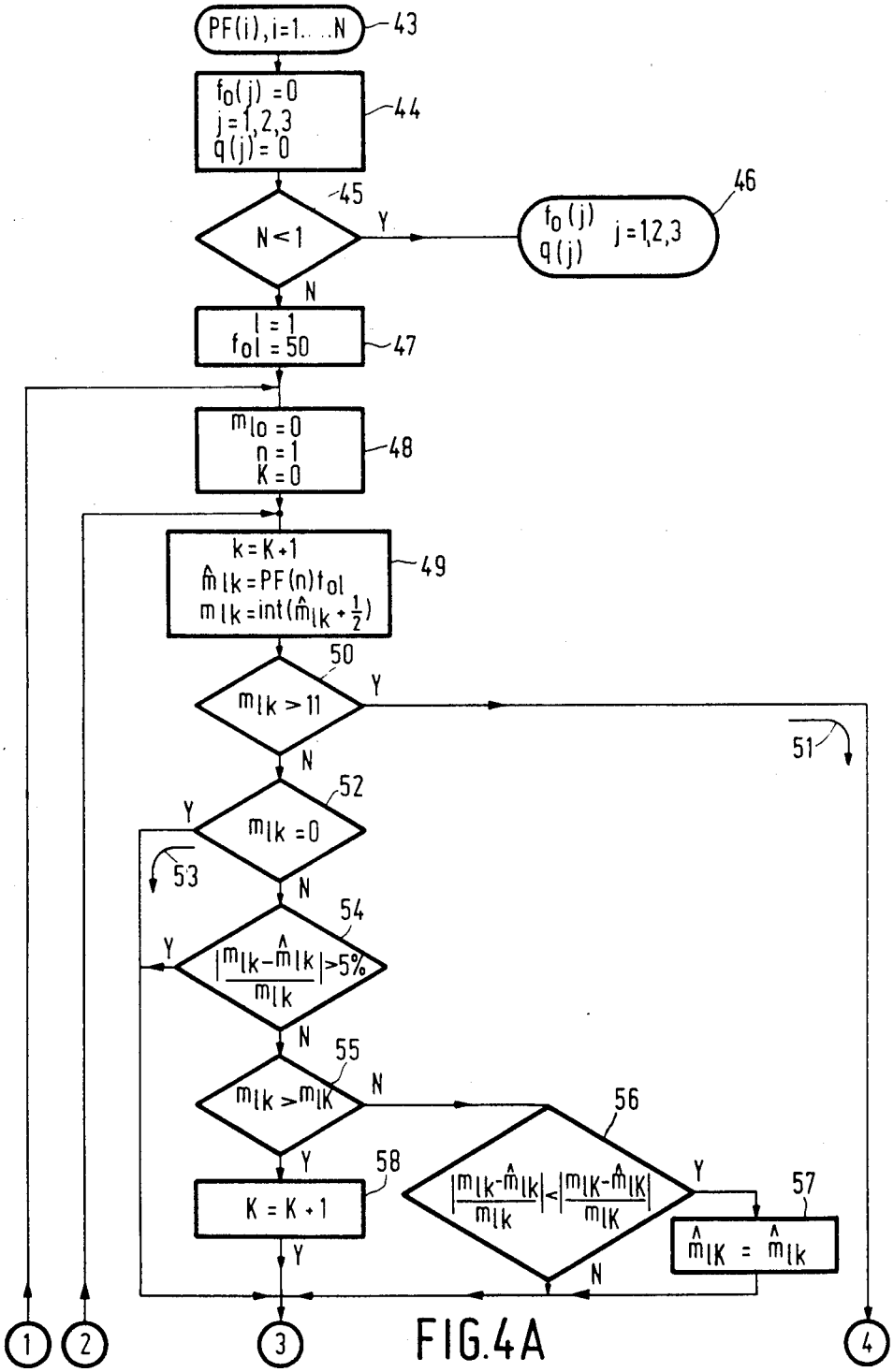
FIGS. 4A and 4B: detailed flow chart of the procedure for determining three $f_o$-estimates with the highest quality figures, based on the significant peak positions in the amplitude spectrum.
Figure 4B:
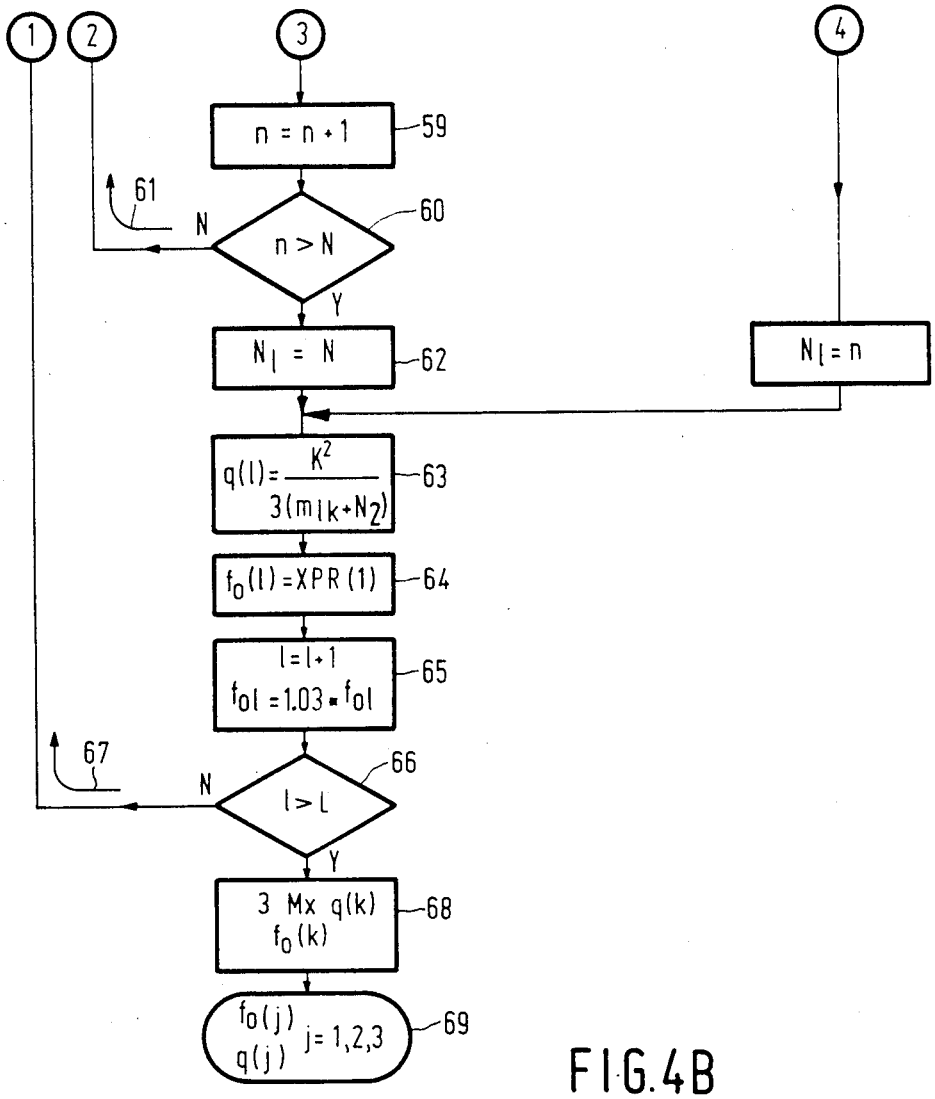

The significant peak positions PF(i) which are supplied by the routine illustrated in FIG. 3 form the input data for the routine illustrated by FIGS. 4A and 4B. These figures connect one below the other in the way indicated.

FIGS. 4A and 4B show the flow chart of a program for the determination of three probable values of the pitch, using the mask concept.

By way of input data the program receives the significant peak positions PF(i), i=1, . . . , N, as illustrated in block 43. They are alternatively denoted as components.

Initially, three $f_o$-estimations $f_o(j)$, j=1, 2, 3 with associated quality figures q(j) are set to zero (block 44).

When the number of components offered is less than one (diamond 45), the routine is left and the values $f_o(j)=0$ are led out (block 46).

If one or more components are led in, the routine is continued via the N-branch of the decision diamond 45.

As a preliminarly action the variable 1 which indicates the number of the mask is set to one and the pitch $f_{o1}$ associated with this mask is set to 50 Hz (block 47). Thereafter some variables are set to an initial value (block 48).

In the next procedure (block 49) an estimation is made, starting at the first component PF(1), of the harmonic number $\hat{m}_{1k}$ associated with the component PF(1) and this value is rounded to the nearest integral number $m_{1k}$.

When $m_{1k}$ exceeds 11 (decision diamond 50), then a large portion of the program is skipped, because in the present speech analysis system harmonics having a number higher than 11 are not included in the pitch determination.

Thereafter it is checked whether $m_{1k}$ has the value zero (decision diamond 52). If not, then it is checked if the component PF(n) falls into an aperture of the mask with pitch $f_{o1}$. When the relative deviation of PF(n) with respect to the nearest harmonic of the fundamental tone $f_{o1}$ is less than a predetermined percentage, 5% in the present system, then PF(n) is assumed to be accommodated in the aperture (decision diamond 54).

When the component PF(n) is located in an aperture of the mask then the N-branch of decision diamond 54 becomes active.

The subsequent operation now relates to the case in which for $m_{1k}$ the same value is found as the value $m_{1K}$ $(K+1=k)$ determined previously. In this case there are two components in the same aperture of the mask. The present system of speech analysis accepts only the component which is nearest to the center of the aperture and the other component is not considered.

The variable K counts the number of the components located in an aperture. When $m_{1k}$ exceeds $m_{1K}$ (decision diamond 55) then K is thereafter increased by one (block 58).

When however $m_{1k}$ does not exceed $m_{1K}$ then it is determined for which of the values $m_{1k}$ and $m_{1K}$ the smallest relative deviation occurs with respect to the center of the aperture (decision diamond 56). When this is the case for $m_{1k}$, then $\hat{m}_{1K}$ is assumed to be equal to $\hat{m}_{1k}$ (block 57). In the other case $\hat{m}_{1K}$ is not changed. In both cases K is not increased.

When the program follows the Y-branch of decision diamond 52, the Y-branch of decision diamond 54 or the N-branch of decision diamond 56, or after the operations of the blocks 57 or 58, the value of n is increased by one (block 59). The variable n counts the offered components PF(i) and when n is less than the total number of components offered (decision diamond 60) then loop 61 is entered.

The described routine then starts again at block 49 for a new value of n. In this way the routine is repeated for all N components PF(i).

When n becomes greater than N, then the Y-branch of decision diamond 60 is followed. Hereafter it is recorded that for the mask having index 1 the number of considered components $N_1$ is equal to N (block 62). When the program follows the Y-branch of decision diamond 50 then $N_1$ is set equal to n (block 63). Components PF(i) having a higher index value have an estimated harmonic number exceeding 11 and are not considered in the pitch determination. In the present speech analysis system a mask has 11 apertures and components PF(i) located outside the mask are not included in the pitch determination.

The following procedure relates to the computation of a quality figure Q which indicates the degree to which the components PF(i) and the mask apertures match each other.

A quality figure can be derived by assuming the sequence of the offered components PF(i) and the sequence of mask apertures to be vectors in a multidimensional space. The distance between the vectors indicates the degree to which the components PF(i) and the mask match each other. The quality figure can then be computed as one divided by the distance. Any other expression which is minimal if the distance is minimal and vice versa can be substituted for the distance.

In an elementary way it can be shown that the distance D can be expressed by:

$$D = \sqrt{N + M - 2K} \tag{2}$$

wherein N represents the number of components PF(i), M the number of apertures of the mask and K the number of the components PF(i) located in the mask apertures.

The quality figure Q can be expressed as:

$$Q = \frac{1}{D^2} = \frac{1}{N + M - 2K} \tag{3}$$

The distance D can be normalized by dividing it by the length of the unity vector:

$$E = \sqrt{N + M - K} \tag{4}$$

This would result in the quality figure:

$$Q = \frac{E^2}{D^2} = \frac{N + M - K}{N + M - 2K} \tag{5}$$

After elementary operations it can be demonstrated that Q is at its maximum in accordance with expression (5) when Q' in accordance with the expression:

$$Q' = \frac{K}{N + M} \tag{6}$$

is as its maximum.

The quality figure is preferably used to express the fact that the computation is the more reliable according as the number of components falling within the mask is larger. To achieve this use is made of a quality measure Q'' for which it then hold that $$Q'' = \frac{K^2}{N + M} \tag{7}$$

In the system used for finding the significant peak positions PF(i), the search is stopped when 6 peak positions have been found (decision diamond 38 in FIG. 2). The most ideal measurement is the measurement in which the 6 peak positions coincide with the first six mask apertures so that for the quality figure Q'' the value 3 is found.

It is advantageous to standardize the quality figure Q'' with this highest attainable value so that the new quality number $Q_n$ becomes:

$$Q_n = \frac{Q''}{3} = \frac{K^2}{3(N + M)} \tag{8}$$

In the ideal case this quality figure reaches the value 1 and in all the other, non-ideal situations it reaches a lower value.

Components PF(i) falling outside the mask do not contribute to the value of K, although they may be in a harmonic relationship with the fundamental tone of the mask. A more suitable quality figure will be obtained when in the expressions for Q the quantity N is replaced by $N_1$, which indicates the number of components located within the range of the mask.

It may happen that apertures of the mask fall outside the range of the components offered and therefore do not allow a component to pass. The quality figure can be corrected for this situation by replacing in the expressions for Q the quantity M by $m_{1K}$, this being the highest number of the apertures which allow a component to pass.

In the procedure shown in FIG. 4A and 4B the quality figure $Q_n$ is calculated in block 63 in accordance with the expression (8) and in block 64 the accurate estimation of the possible pitch is computed in accordance with the expression (1).

In block 65 the value of 1 is increased by one and a new value of $f_{o1}$ is determined, which is 3% higher than the previous value. In decision diamond 66 it is checked whether 1 exceeds a limit value L. This limit value is set to 80 in the present speech analysis system. If 1 does not exceed L, the diamond 66 is left via the N branch and loop 67 is entered, whereafter the whole search would be started again. If, however, the limit value L is exceeded, then the diamond 66 is left via the Y-branch and in block 68 the three highest quality figures with the associated estimations of the pitch are sought which are then available at the output of the operation in block 69.

TIME DOMAIN SECTION

Figure 5:
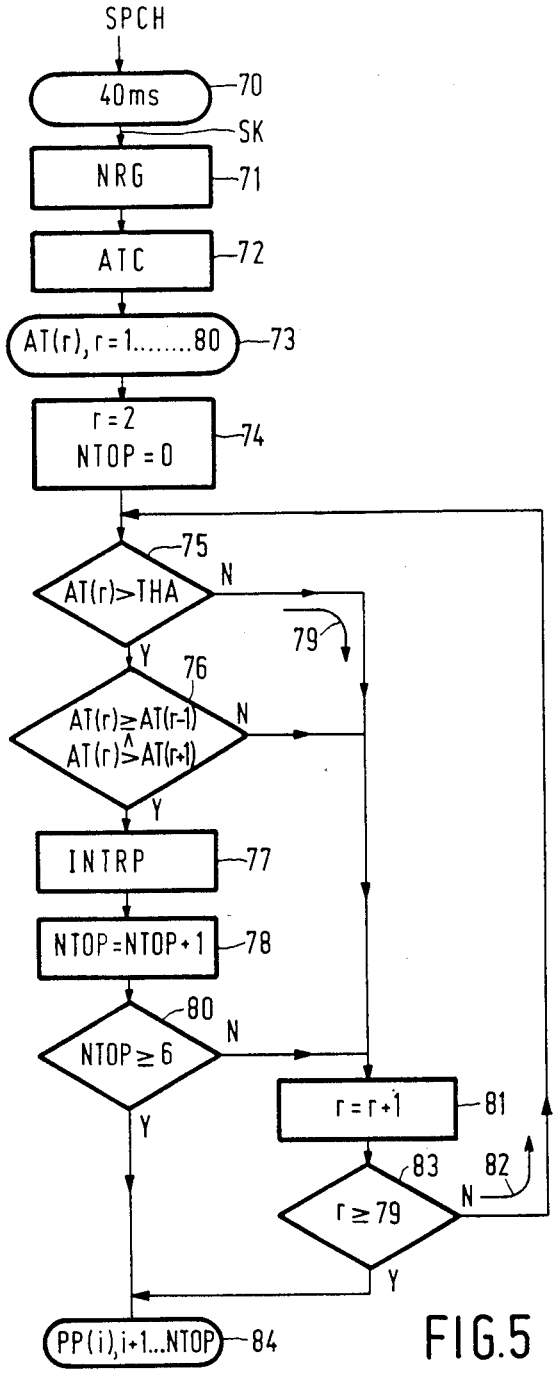
FIG. 5: circuit diagram for the determination of significant peak positions in the normalized autocorrelation function.

FIG. 5 shows in greater detail the procedure for obtaining values of the significant positions in the time domain. This procedure is based on the same 40 ms speech segment (block 70) as in FIG. 3 (block 27). Now the energy of this signal is calculated in block 71, bearing the inscription NRG. This energy E is defined by:

$$E = \frac{1}{N} \sum_{K=1}^{N} S_{K2} \; (N = 100) \tag{9}$$

The normalized autocorrelation function of the speech segment is now computed in block 72 in accordance with the expression:

$$AT(j) = \frac{\frac{1}{N-j} \sum_{K=1}^{N-j} S_K \cdot S_{K+j}}{E} \tag{10}$$

for j=1, . . . 80.

This function is represented in block 73 in which the variable j is replaced by r. As initial values for the subsequent routine r=2 and NTOP=0 are now set in block 74.

Starting with the autocorrelation coefficient AT(2) it is investigated in decision diamond 75 whether the autocorrelation coefficient AT(2) exceeds a threshold value THA. The N-branch of diamond 75 leads to block 81 which indicates that r is increased by one. Thereafter it is investigated in decision diamond 83 whether r exceeds or has become equal to 79. As long as this is not the case the loop 82 to the decision diamond 75 is followed. The function of decision diamond 75 is then repeated with a new value of r.

The Y-branch of decision diamond 75 leads to decision diamond 76 in which it is investigated whether the autocorrelation coefficient is larger than or equal to the preceding autocorrelation coefficient AT(1) and whether autocorrelation coefficient AT(2) exceeds the subsequent autocorrelation coefficient AT(3). When the autocorrelation coefficient forms a local maximum, then the Y-branch of diamond 76 is followed. The N-branch of diamond 76 leads to block 81 which indicates that r is increased by one. When the Y-branch of decision diamond 76 is followed, then an operation is effected to determine the position on the time axis of the local maximum of the autocorrelation function. To this end use is made of interpolation between the values AT(r−1), AT(r) and AT(r+1) with a second-order polynominal (parabolic interpolation). This function is represented by block 77 bearing the inscription INTRP. In block 78 the number of local maxima NTOP is increased by one. Searching for local maxima in the autocorrelation function is continued until a maximum of six significant peak positions PP(i) have been determined.

When six significant peak positions have been found, then the Y-branch of the decision diamond 80 becomes active and the significant peak positions are led out. (block 84).

Figure 6A:
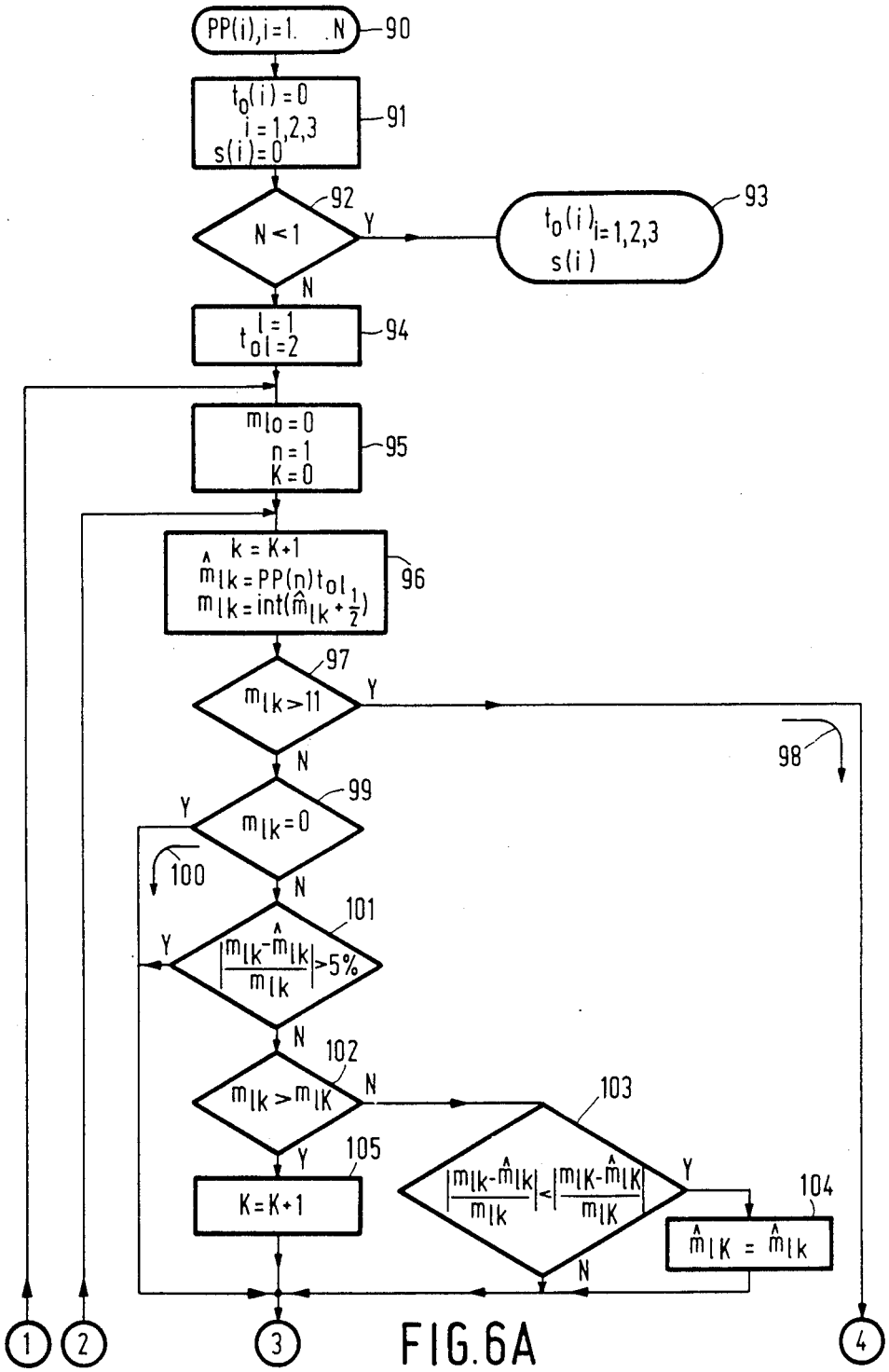
FIGS. 6A and 6B: detailed flow chart of the procedure for determining three $f_o$-estimates with the highest quality figures, based on the significant peak positions in the normalized autocorrelation function.
Figure 6B:
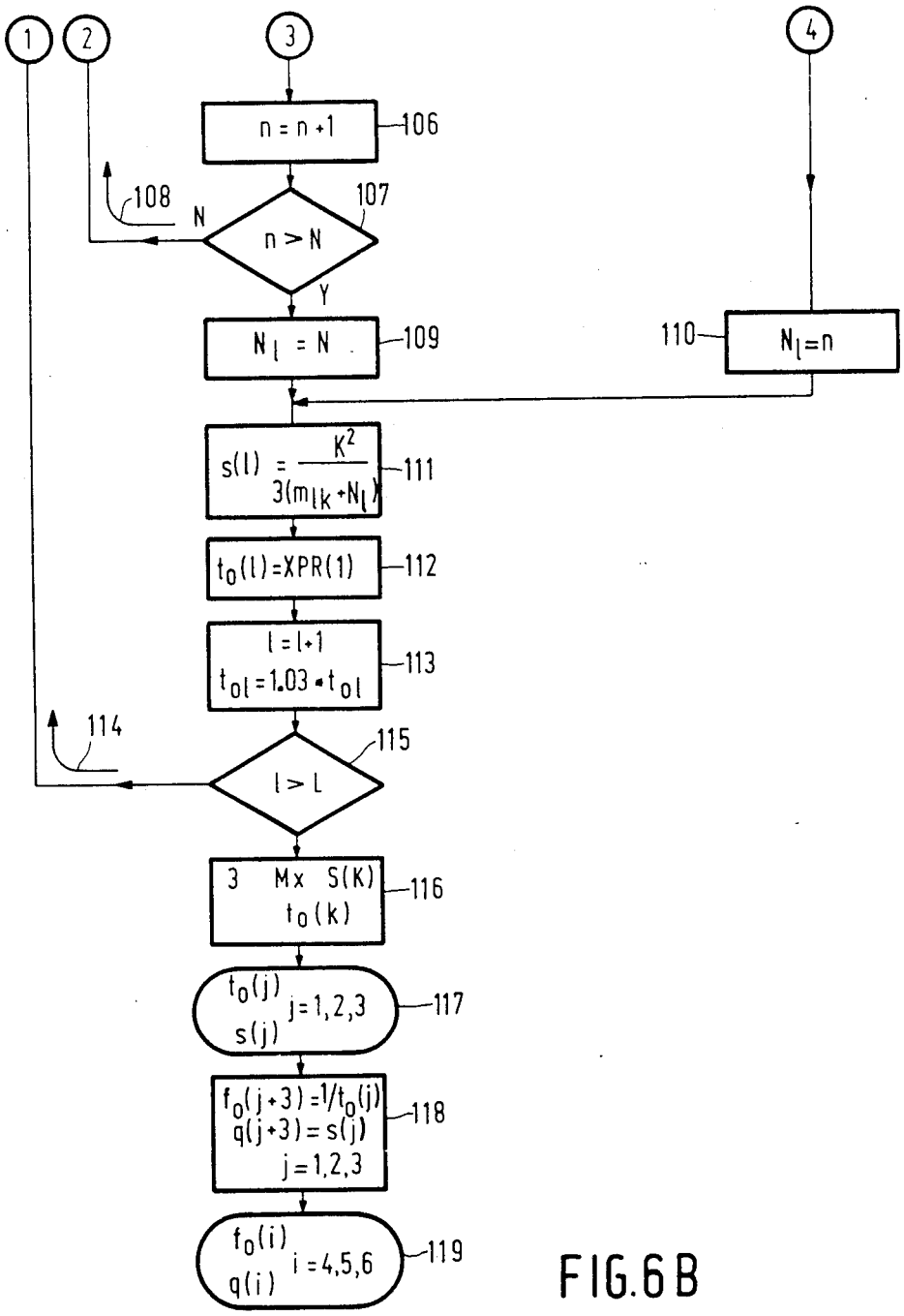

The significant peak positions PP(i) supplied by the routine in accordance with FIG. 5 form the input data for the routine in accordance with FIGS. 6A and 6B. These Figures should be placed one below the other in the manner indicated.

FIGS. 6A and 6B show the flow chart of a procedure for determining three likely values of the pitch, using the mask concept. The mask concept is now applied to the significant peak positions PP(i) which are located in time domain and consequently represent period durations.

The program receives as input data the significant peak positions PP(i) i=1 . . . N, as illustrated in block 90. These input data are alternatively denoted as components. Initially, three $t_o$-estimations $t_o(i)$, i=1, 2, 3 with associated quality figures s(i) are set to zero (block 91). When the number of offered components is less than one (diamond 92) then the routine is left via the Y-branch of diamond 92 and the values $t_o(i)=0$ are led out (block 93). If one or more components are led in then the routine is continued via the N-branch of diamond 92.

By way of preparation, the variable 1 which indicates the number of the mask is set to one and the period duration $t_{o1}$ associated with this mask is adjusted to 2 ms (block 94). In the subsequent operation (block 95) some variables are set to their initial values. In block 96, from the first component PP(1) onwards, an estimation is made of the harmonic number $\hat{m}_{1k}$ associated with the component PP(1) and this value is rounded to the nearest integral number $m_{1k}$. If $m_{1k}$ exceeds 11 (decision diamond 97) then a large portion of the procedure via the loop 98 is skipped, as in the present speech analysis system are harmonic relation having a number higher than 11 is not included in the pitch determination.

Thereafter it is checked whether $m_{1k}$ has the value zero (in decision diamond 99). If not then diamond 99 is left via the N-branch and it is checked whether the component PP(n) falls into an aperture of the mask having period $r_{o1}$. When the relative deviation of PP(n) relative to the nearest multiple of the fundamental period $t_{o1}$ is less than a predetermined percentage, 5% in the present system, then PP(n) is assumed to be located in the aperture (decision diamond 101). When the component PP(n) is located in an aperture of the mask then the N-branch of decision diamond 101 becomes active.

The following operation relates to the case in which for $m_{1k}$ the same value is found as the value $m_{1K}$ ($K+1=k$) determined the previous time. In that case there are two components in the same aperture of the mask.

The present speech analysis system accepts only the component located nearest to the center of the aperture and does not take the other components into account. The variable K counts the number of the components located in an aperture. When $m_{1k}$ exceeds $m_{1K}$ (decision diamond 102) then K is thereafter increased by one (block 105). When however $m_{1k}$ does not exceed $m_{1K}$ then diamond 102 is left via the N branch and it is determined for which of the values $m_{1k}$ and $m_{1K}$ the smallest deviation occurs relative to the center of the aperture (decision diamond 103). When this is the case for $m_{1k}$ the $\hat{m}_{1K}$ is set equal to $\hat{m}_{1k}$ (block 104). In the other case $\hat{m}_{1K}$ is not changed. In both cases K is not increased.

When the program follows the Y-branch of decision diamond 99, the Y-branch of decision diamond 101 or the N-branch of decision diamond 103 or after the operations illustrated by the blocks 104 or 105, the value of n is increased by one (block 106).

The variable n counts the offered components PP(n) and when n does not exceed the total number of components offered (decision diamond 107) then the loops 108 is followed. The described routine is then repeated from block 96 onwards for a new value of n. In this way the routine is repeated for all the N components PP(i).

When n becomes larger than N, then the Y-branch of decision diamond 107 is followed. Thereafter it is recorded that for the mask having index 1 the number of components $N_1$ considered is equal to N (block 109). When the program follows the Y-branch of decision diamond 97, then $N_1$ is set equal to n (block 110). Components PP(i) having a higher index value have an estimated harmonic number which exceeds 11 and are not taken into account in the pitch determination. In the present speech analysis system a mask has 11 apertures and components PP(i) located outside the mask are not included in the pitch determination.

In the block 111 the quality figure is now calculated in accordance with expression (8) and in block 112 the accurate estimation of the possible period is computed in accordance with the expression (1).

In block 113 1 is increased by one and a new value of $t_{o1}$ is computed, which is 3% higher than the previous value. In decision diamond 115 it is checked whether 1 has become larger than a limit value L. In the present speech analysis system this limit value is set at 80. If 1 does not exceed L then diamond 115 is left via the N-branch, whereafter loop 114 is entered and the entire search procedure starts again. If, however, the limit value L is exceeded then the decision diamond is left via the Y-branch, whereafter the block 116 the three highest quality numbers S(K) with the associated period estimations $t_o(k)$ are looked for. These three best-matching period estimates $t_o(i)$ with associated quality numbers s(j) are now available in block 117 and are thereafter converted in block 118 into an estimation of the pitch by computing the inverse of $t_o(j)$.

COMBINING SECTION

Now three estimations for the pitch with associated quality numbers are available, obtained from the pitch meter which is active in the frequency domain denoted by $f_o(j)$, j=1, 2, 3, as indicated in block 69 and in addition three estimations for $f_o$ with associated quality figures obtained from the autocorrelation pitch meter active in the time domain denoted by $f_o(i)$, i=4, 5, 6, as indicated in block 119. In the combining circuit CMB which now follows (block 18, FIG. 1) these results are combined to form a more reliable measurement of the pitch.

In addition, it is now in principle possible to have more data than the data mentioned above decide on the pitch ultimately to be assigned.

Thoughts may go towards a pitch meter still further to be specified or to pitch estimates of the previous measuring interval with reduced quality numbers (reduced for the purpose of having past data be of somewhat less weight during the determination of the present pitch) or to the measuring results derived from the recent past (tracking).

Figure 7:
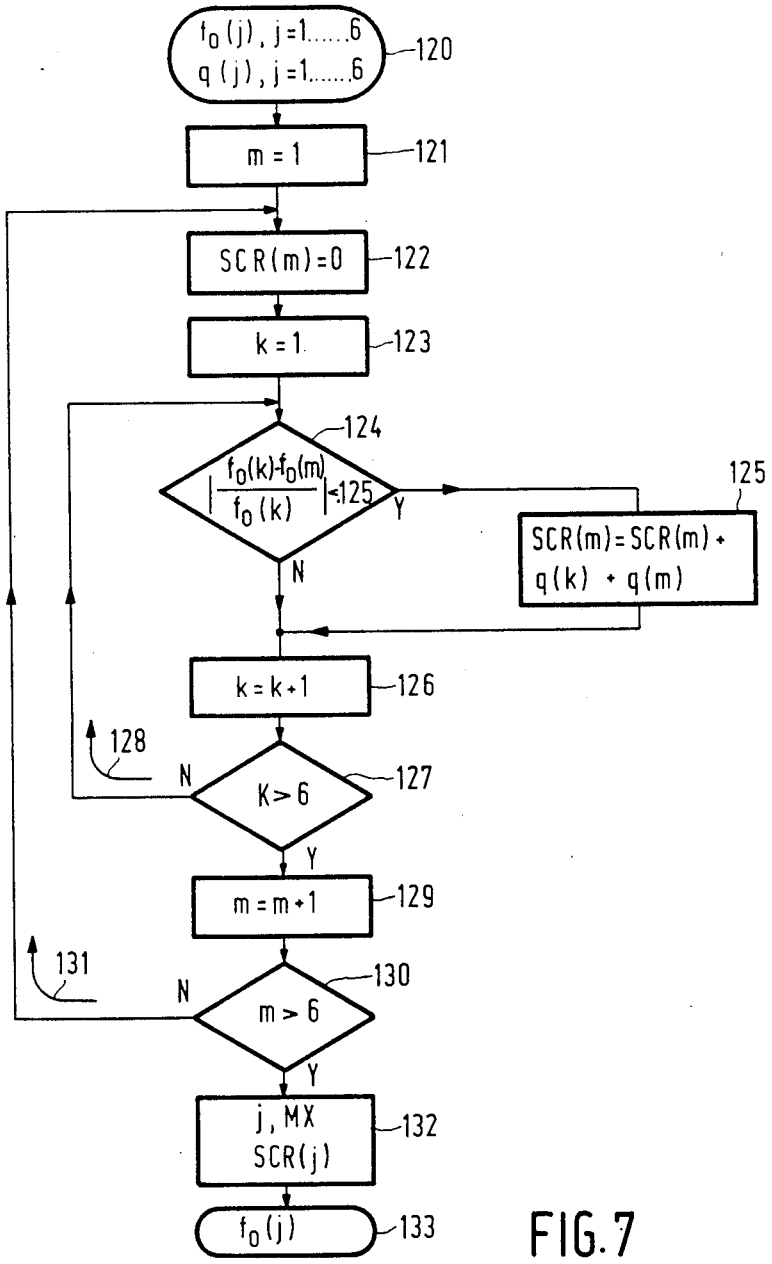
FIG. 7: flow chart of the combining procedure which combines the data into a more reliable estimate of the pitch.

The combining circuit is shown in FIG. 7 and starts from the data in block 120, being the six possible estimations of the pitch with associated quality figures.

In block 121 the counting variable m is set to one and in block 122 the quantity SCR(m) is set to zero. In block 123 the counting variable k which is active in loop 128 is set to one. If the relative deviation between the $m^{th}$ pitch estimation and the $k^{th}$ pitch estimation is less than 12.5%, then the decision diamond 125 is left via the Y-branch. In that case, in block 125, the product of the quality figures of the $m^{th}$ and the $k^{th}$ pitch estimation is added to SCR(m). If diamond 124 is left via the N-branch then no contribution is added to SCR(m) and block 126 is entered where the variable k is increased by one. In decision diamond 127 it is checked whether the variable k is larger than 6. If not then the loop 128 is entered via the N-branch of diamond 127. If the variable k has become larger than 6, then decision diamond 127 is left via the Y-branch, whereafter in block 129 the variable m is increased by one. In decision diamond 130 it is checked whether the variable m exceeds 6. If not then the diamond 130 is left via the N-branch and the loop 131 is entered. If the variable m exceeds 6 then the diamond 130 is left via the Y-branch. In this way it is computed in SCR(m) for all the 6 pitch estimations how well the 6 pitch estimations match. In block 132 the index j is now determined for which the associated SCR(j) assumes the highest value. Finally, the pitch estimation $f_o(j)$ becomes available as the most likely estimation, in block 133.

What is claimed is:

1. A method of analyzing human speech for determining the pitch of speech segments while using more than one pitch detection algorithm, characterized by comprising the steps of:

(a) determining an amplitude spectrum of a speech segment in a first elementary pitch meter, and determining significant peak positions in said spectrum, (b) determining an autocorrelation function and significant peak positions therein in a second elementary pitch meter, (c) utilizing said significant peak positions of the amplitude spectrum and the autocorrelation function, respectively, as input data for selecting a value for the pitch and period, respectively, and determining a sequence of consecutive integral multiples of said value, and the determination of intervals around said value and the multiples thereof, these intervals defining apertures of a mask, said apertures corresponding to harmonic multiplication factors, (d) computing a quality figure for each pitch and period, respectively, in accordance with a criterion indicating the degree to which the significant peak positions and mark apertures match, (e) repeating steps (c) and (d) for consecutive higher values of the pitch and period, respectively, up to a predetermined highest value, to provide a sequence of quality figures associated with these pitch and period values, respectively, (f) selecting a predetermined number of values of said pitch and period, respectively, having the highest quality figures, (g) converting the values for the respective periods into values for pitch, and (h) combining the predetermined numbers of selected values for pitch, and for pitch converted from period, with their associated quality figures to form an estimation of the most likely pitch.

2. An apparatus for analyzing human speech to determine a pitch of speech segments, using more than one pitch detection algorithm, comprising a first elementary pitch meter, operating in the frequency domain, for determining a first plurality of significant peak frequencies in a speech segment, means for computing a quality figure for each of said significant peak frequencies, a second elementary pitch meter, operating in the time domain, for determining significant peak periods of said segment, means for computing a quality figure for each of said significant peak periods, means for determining period-derived frequencies corresponding to said significant peak periods, means for selecting a predetermined number of values of said significant peak frequencies and said significant peak period-derived frequencies, respectively having the highest quality figures, and combining said selected values of frequency and period-derived frequency with the associated quality figures to form an estimate of the most likely pitch.

3. An apparatus as claimed in claim 2, characterized in that said first and second means for computing a quality figure each comprise a respective harmonic sieve for selecting a value for pitch, based respectively on frequency or period, and determining a sequence of consecutive integral multiples of this value and intervals around this value and the multiples thereof, these intervals defining apertures of a mask, said apertures corresponding to harmonic multiplication factors; and computing a quality figure in accordance with a criterion indicating the degree to which significant peak positions and the mask apertures match; and repeating said selecting and computing steps for consecutively higher values of pitch up to a predetermined higher value.

4. An apparatus as claimed in claim 3, characterized in that said first elementary pitch meter comprises windowing means for determining an amplitude spectrum of said speech segment, means for computing a Fourier transform of said amplitude spectrum, and means for determining the significant peak positions in said amplitude spectrum.

5. An apparatus as claimed in claim 4, characterized in that said second elementary time meter comprises means for determining significant peak positions in an autocorrelation function of said segment, said significant peak positions corresponding to said significant peak periods.

6. An apparatus as claimed in claim 5, characterized in that said means for combining selects one of said frequencies as the most likely pitch.

7. An apparatus as claimed in claim 3, characterized in that said means for combining selects one of said frequencies as the most likely pitch.

8. An apparatus as claimed in claim 2, characterized in that said means for combining selects one of said frequencies as the most likely pitch.

* * * * *